US009909249B2

(12) United States Patent
Kim et al.

(10) Patent No.: US 9,909,249 B2
(45) Date of Patent: Mar. 6, 2018

(54) LAUNDRY TREATING APPARATUS

(71) Applicant: LG ELECTRONICS INC., Seoul (KR)

(72) Inventors: Hyojun Kim, Seoul (KR); Sangwook Hong, Seoul (KR); Youngsuk Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 175 days.

(21) Appl. No.: 14/919,931

(22) Filed: Oct. 22, 2015

(65) Prior Publication Data

US 2016/0115636 A1 Apr. 28, 2016

(30) Foreign Application Priority Data

Oct. 28, 2014 (KR) ..... 10-2014-0147298

(51) Int. Cl.

| | |
|---|---|
| ***D06F 39/08*** | (2006.01) |
| ***D06F 39/10*** | (2006.01) |
| ***D06F 33/02*** | (2006.01) |
| ***D06F 58/22*** | (2006.01) |
| ***D06F 58/20*** | (2006.01) |

(52) U.S. Cl.

CPC ..... *D06F 39/088* (2013.01); *D06F 33/02* (2013.01); *D06F 39/10* (2013.01); *D06F 58/206* (2013.01); *D06F 58/22* (2013.01)

(58) Field of Classification Search

CPC ..... D06F 39/088; D06F 39/10; D06F 33/02; D06F 58/22; D06F 58/206

See application file for complete search history.

(56) References Cited

U.S. PATENT DOCUMENTS

| | | | |
|---|---|---|---|
| 5,628,122 | A | 5/1997 | Spinardi |
| 7,644,515 | B2 | 1/2010 | Doh |
| 8,166,670 | B2 | 5/2012 | Poy |
| 8,201,345 | B2 | 6/2012 | Dalton |
| 8,240,064 | B2 | 8/2012 | Steffens |

(Continued)

FOREIGN PATENT DOCUMENTS

| | | |
|---|---|---|
| CN | 101228306 | 7/2008 |
| CN | 102149866 | 8/2011 |

(Continued)

OTHER PUBLICATIONS

Machine translation of JP 2014-046133 A, no date.*

(Continued)

*Primary Examiner* — Joseph L Perrin
(74) *Attorney, Agent, or Firm* — KED & Associates, LLP

(57) ABSTRACT

A laundry treating apparatus is provided that may include a laundry accommodation device that provides a space in which laundry is accommodated; a circulation passage provided outside of the laundry accommodation device, and providing a space in which air circulates to an inside of the laundry accommodation device; a heat exchanger provided in the circulation passage; a filter device provided in the circulation passage, that filters foreign materials introduced to the heat exchanger; and a washer provided between the heat exchanger and the filter device, that sprays washing water to each of the heat exchanger and the filter device.

9 Claims, 12 Drawing Sheets

(56) References Cited

U.S. PATENT DOCUMENTS

| | | | | |
|---|---|---|---|---|
| 8,438,750 | B2 * | 5/2013 | Dittmer | D06F 58/22 134/10 |
| 8,656,604 | B2 | 2/2014 | Ediger | |
| 8,800,165 | B2 | 8/2014 | Kwon | |
| 8,863,405 | B2 | 10/2014 | Lee | |
| 9,027,256 | B2 | 5/2015 | Kim | |
| 9,052,142 | B2 | 6/2015 | Kim | |
| 9,163,352 | B2 | 10/2015 | Han | |
| 9,194,073 | B2 | 11/2015 | Kwon | |
| 9,279,211 | B2 | 3/2016 | Kim | |
| 2004/0221474 | A1 | 11/2004 | Slutsky et al. | |
| 2008/0276656 | A1 | 11/2008 | Kitamura et al. | |
| 2010/0146811 | A1 | 6/2010 | Steffens | |
| 2010/0154240 | A1 | 6/2010 | Grunert | |
| 2011/0167662 | A1 | 7/2011 | Dittmer et al. | |
| 2011/0173834 | A1 | 7/2011 | Arrigoni | |
| 2012/0246960 | A1 * | 10/2012 | Lee | D06F 58/206 34/86 |
| 2013/0219734 | A1 | 8/2013 | Kim et al. | |
| 2016/0115636 | A1 | 4/2016 | Kim | |

FOREIGN PATENT DOCUMENTS

| | | | |
|---|---|---|---|
| CN | 103282574 | | 9/2013 |
| CN | 103608508 | | 2/2014 |
| CN | 103774402 | | 5/2014 |
| CN | 103797174 | | 5/2014 |
| DE | 10-2008-054548 | | 6/2010 |
| DE | 10 2008 054 832 | A1 | 7/2010 |
| DE | 10 2010 039 602 | A1 | 2/2012 |
| DE | 10 2014 204 299 | A1 | 9/2015 |
| EP | 1 669 487 | | 6/2006 |
| EP | 2 039 819 | A1 | 3/2009 |
| EP | 2 202 349 | | 6/2010 |
| EP | 2 386 679 | | 11/2011 |
| EP | 2 559 805 | | 2/2013 |
| EP | 2 196 577 | | 6/2016 |
| JP | 2006-187449 | A | 7/2006 |
| JP | 2014046133 | | 3/2014 |
| JP | 2014046133 | A * | 3/2014 ..... D06F 58/206 |
| KR | 10-2007-0076853 | A | 7/2007 |
| WO | WO 2011/057954 | | 5/2011 |
| WO | WO 2011/061068 | | 5/2011 |
| WO | WO 2013/151345 | | 10/2013 |
| WO | WO 2014/038112 | A1 | 3/2014 |
| WO | WO 2014/115999 | | 7/2014 |
| WO | WO 2014/169955 | A1 | 10/2014 |

OTHER PUBLICATIONS

European Search Report dated Mar. 14, 2016 issued in Application No. 15191431.4.

Australian Office Action dated Mar. 24, 2016 issued in Application No. 2015246161.

Australian Office Action dated Jun. 3, 2016 issued in Application No. 2015249045.

U.S. Office Action dated Dec. 2, 2016 issued in co-pending U.S. Appl. No. 14/920,148.

Australian Office Action dated Oct. 31, 2016 issued in Application No. 2015246161.

U.S. Appl. No. 14/920,148, filed Oct. 22, 2015.

European Search Report dated Jan. 12, 2016.

Chinese Office Action dated Apr. 6, 2017 issued in Application No. 201510683291.3 (with English Translation).

Chinese Office Action dated Apr. 20, 2017 issued in Application No. 201510683383.1 (with English translation).

Chinese Office Action dated Sep. 15, 2017 issued in Application No. 201510683383.1 (with English translation).

* cited by examiner

LAUNDRY TREATING APPARATUS

CROSS-REFERENCE TO RELATED APPLICATION(S)

Pursuant to 35 U.S.C. § 119(a), this application claims the benefit of earlier filing date and right of priority to Korean Application No. 10-2014-0147298, filed in Korea on Oct. 28, 2014, the contents of which is incorporated by reference herein in its entirety.

BACKGROUND

1. Field

A laundry treating apparatus is disclosed herein.

2. Background

A laundry treating apparatus includes an apparatus for washing or drying laundry, and an apparatus for washing and drying laundry. A laundry treating apparatus capable of drying laundry is configured to supply air at a high temperature (hot blast) to laundry, which may be classified into an exhaust type and a circulation type (condensation type) according to an air flow method.

The circulation type laundry treating apparatus includes structure to circulate air inside of a laundry accommodation unit or device in which laundry is placed. With this structure, air discharged from the laundry accommodation device is heated after moisture is removed (dehumidifying) from the air, and then the air is re-supplied to the laundry accommodation device.

The exhaustion type laundry treating apparatus includes structure to supply heated air to a laundry accommodation device. With this structure, air discharged from the laundry accommodation device is discharged outside of the laundry treating apparatus, without being circulated.

In the circulation type laundry treating apparatus, air is suctioned from a tub. In this case, heat exchange efficiency is lowered when air at a high temperature (hot blast) is supplied, due to foreign materials. Thus, the circulation type laundry treating apparatus is provided with a filter.

The conventional laundry treating apparatus is not provided with a heat exchanger to heat air and then supply the air at a high temperature (hot blast), and means to clean the aforementioned filter. Thus, heat exchange efficiency may be lowered.

BRIEF DESCRIPTION OF THE DRAWINGS

Embodiments will be described in detail with reference to the following drawings in which like reference numerals refer to like elements, and wherein.

DETAILED DESCRIPTION

Figure 1:
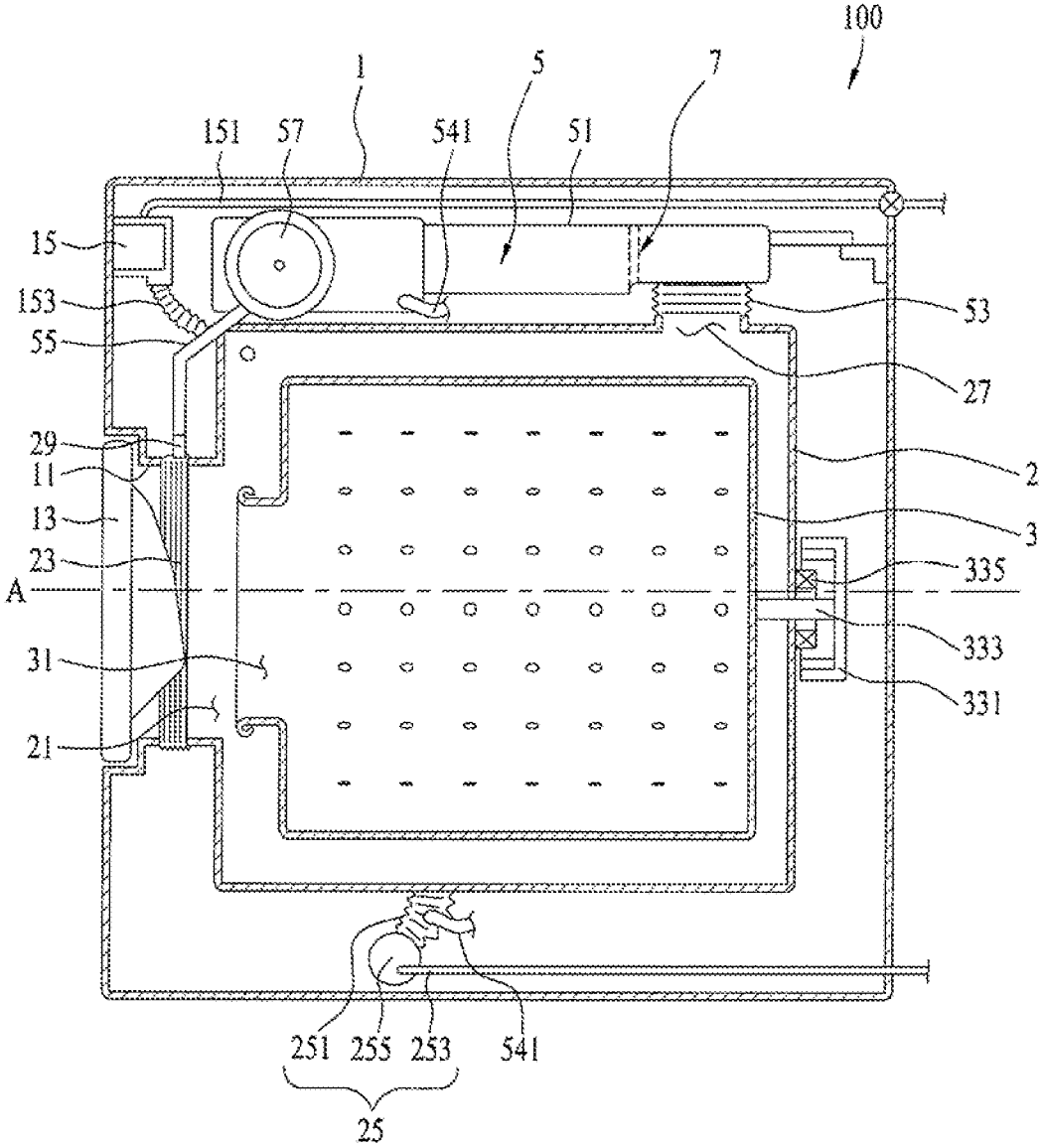
FIGS. 1 and 2 are cross-sectional and perspective views of a laundry treating apparatus according to an embodiment.

FIG. 1 is a cross-sectional view of a laundry treating apparatus according to an embodiment. As shown in FIG. 1, laundry treating apparatus 100 may include a cabinet 1, which forms an outer appearance thereof, laundry accommodation units or devices 2 and 3 provided in the cabinet 1 to accommodate laundry therein, and a hot blast supply unit or device 5 that supplies a hot blast to the laundry accommodation devices 2 and 3. The cabinet 1 may include an introduction opening 11, into which laundry may be introduced, and a door 13 rotatably provided at the cabinet 1 to open and close the introduction opening 11.

In a case in which the laundry treating apparatus 100 serves as an apparatus for only drying laundry, the laundry accommodation devices may be provided with only a drum 3 rotatably provided in the cabinet 1. On the other hand, if the laundry treating apparatus 100 serves as an apparatus for washing and drying laundry, the laundry accommodation devices may be provided with a tub 2 provided in the cabinet 1 to accommodate washing water therein, and a drum 3 rotatably provided in the cabinet 1 to accommodate laundry therein.

The tub 2 may have a hollow cylindrical shape, and be fixed to an inside of the cabinet 1. A tub introduction opening 21, through which laundry may be introduced, may be provided on or at a front surface of the tub 2 and correspond to the introduction opening 11.

A gasket 23 may be provided between the tub introduction opening 21 and the introduction opening 11. The gasket 23 may prevent washing water stored in the tub 2 from leaking outside of the tub 2, and prevent vibrations from the tub 2 from being transmitted to the cabinet 1 when the drum 3 is rotated. Thus, the gasket 23 may be a vibration isolation member, and may be formed of rubber.

The tub 2 may be installed such that a central longitudinal axis of the tub 2 extends parallel to a ground surface on which the cabinet 1 is supported, or may be installed with a predetermined inclination angle with respect to the ground surface. If the tub 2 is installed with an inclination of a predetermined angle with respect to the ground surface, the predetermined inclination angle may be less than about 90°.

An exhaust unit or device 27, through which air inside the tub 2 may be discharged, may be provided at an upper portion of a circumferential surface of the tub 2. A drain unit or device 25 that discharges the washing water stored in the tub 2 may be provided at a lower portion of the tub 2.

The exhaust device 27 may be provided in the tub 2. The exhaust device 27 may be spaced a predetermined distant from a straight line (A) that passes through a center of the tub 2, for example, a predetermined distance (L1) (refer to FIG. 2). The reason is to easily discharge air inside of the tub 2 from the tub 2 through the exhaust device 27 when the drum 3 is rotated.

The drain device 25 may include a drain pump 255, a first drain pipe 251 that connects the drain pump 255 with the tub 2, and a second drain pipe 253 that guides washing water introduced into the drain pump 255 outside of the cabinet 1.

The tub 2 may be supplied with washing water through a water supply pipe 151 that connects the tub 2 with a water supply source. If a detergent supply unit or device 15 that supplies detergent to the tub 2 is provided at the cabinet 1, the water supply pipe 151 may be provided to supply washing water to the detergent supply device 15. In this case, the washing water supplied to the detergent supply device 15 may be supplied to the tub 2 through a detergent supply pipe 153.

The drum 3 may have a hollow cylindrical shape, and may be provided in the tub 2. The drum 3 may be rotatable by a drive provided outside of the tub 2. In this case, the drive may include a stator 335 fixed to a rear surface of the tub 2, a rotor 331 rotated by an electromagnetic operation with the stator 335, and a rotational shaft 333 that connects a rear surface of the drum 3 with the rotor 331 by passing through the rear surface of the tub 2.

A drum introduction opening 31, which may communicate with the introduction opening 11 and the tub introduction opening 21, may be provided on a front side of the drum 3. With such a configuration, a user may put laundry into the drum 3 through the introduction opening 11, or may withdraw laundry within the drum 3 outside of the cabinet 1.

Figure 2:
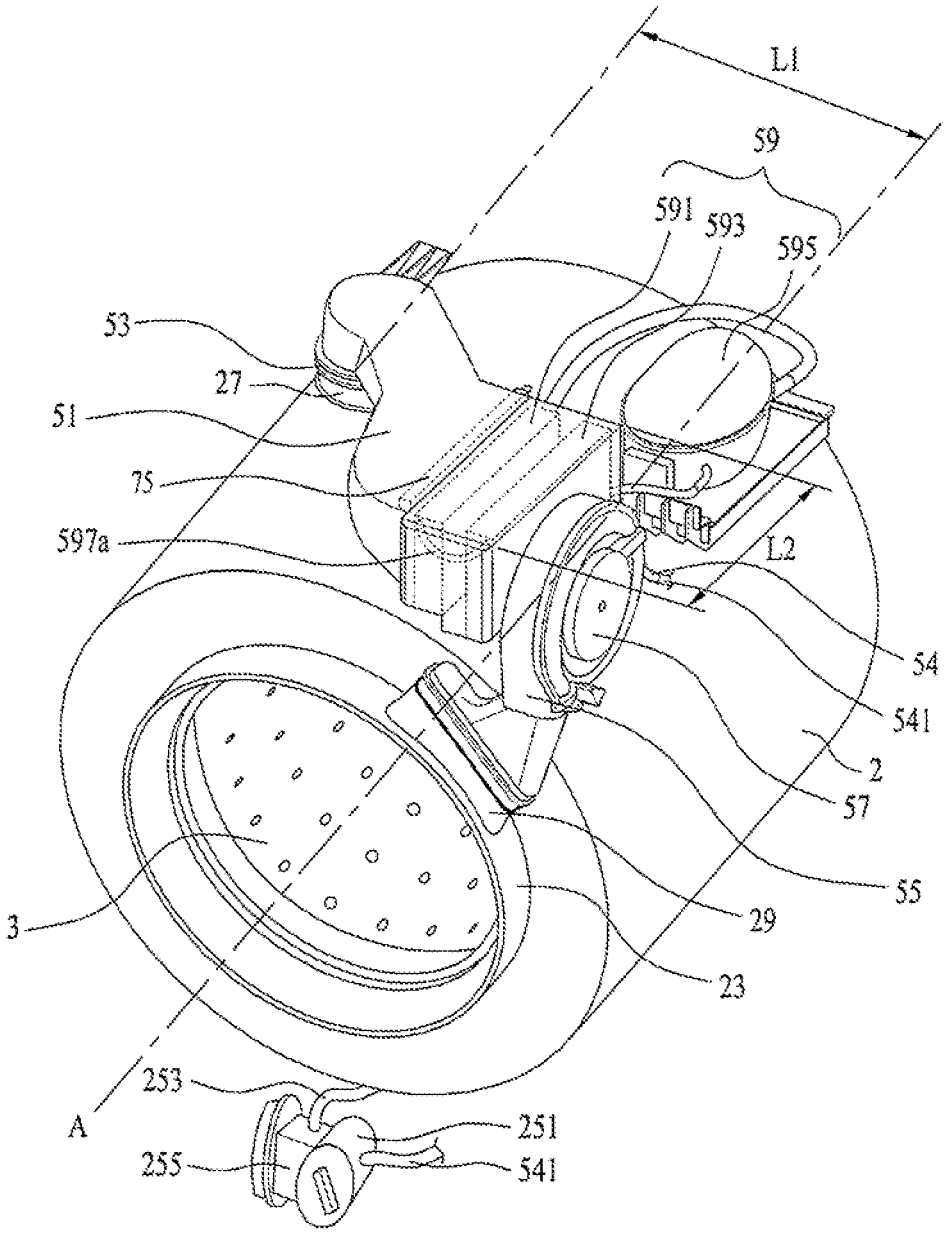

As shown in FIG. 2, the hot blast supply device 5 may include circulation passages 51, 53, and 55 that guide air discharged from the inside of the tub 2 to a front side of the tub 2, a blower 57 provided at or in the circulation passages 51, 53, and 55 that circulates air inside of the tub 2, and a heat exchange unit or heat exchanger 59 provided in the circulation passages 51, 53, and 55. The circulation passages 51, 53, and 55 may include a first connection duct 53 connected to a rear side of the tub 2, a duct 51 connected to the first connection duct 53 and having the heat exchanger 59 provided therein or thereon, and a second connection duct 55 that guides air discharged from the duct 51 to a front side of the tub 2.

The first connection duct 53 may be a passage connected to the exhaust device 27 provided on or at a rear side of the circumferential surface of the tub 2, and may be a vibration isolation member, and may be formed of rubber. This may prevent vibrations transmitted to the tub 2 from being transmitted to the heat exchanger 59 provided in the duct 51 through the first connection duct 53 when the drum 3 is rotated.

The first connection duct 53 may include a bellows, in order to effectively prevent transmission of vibrations generated from the tub 2, to the duct 51 and the heat exchanger 59. The second connection duct 55 may be connected to any point on the tub 2, if air discharged from the duct 51 is guided to a front side of the tub 2. FIG. 2 illustrates a case in which the second connection duct 55 supplies air into the tub 2 through the gasket 23. In this case, a supply unit or device 29 that communicates with the second connection duct 55 may be further provided at the gasket 23.

The blower 57 may be provided at the second connection duct 55. The blower 57 may include an impeller (not shown) provided in the second connection duct, and an impeller motor (not shown) that rotates the impeller.

Figure 3:
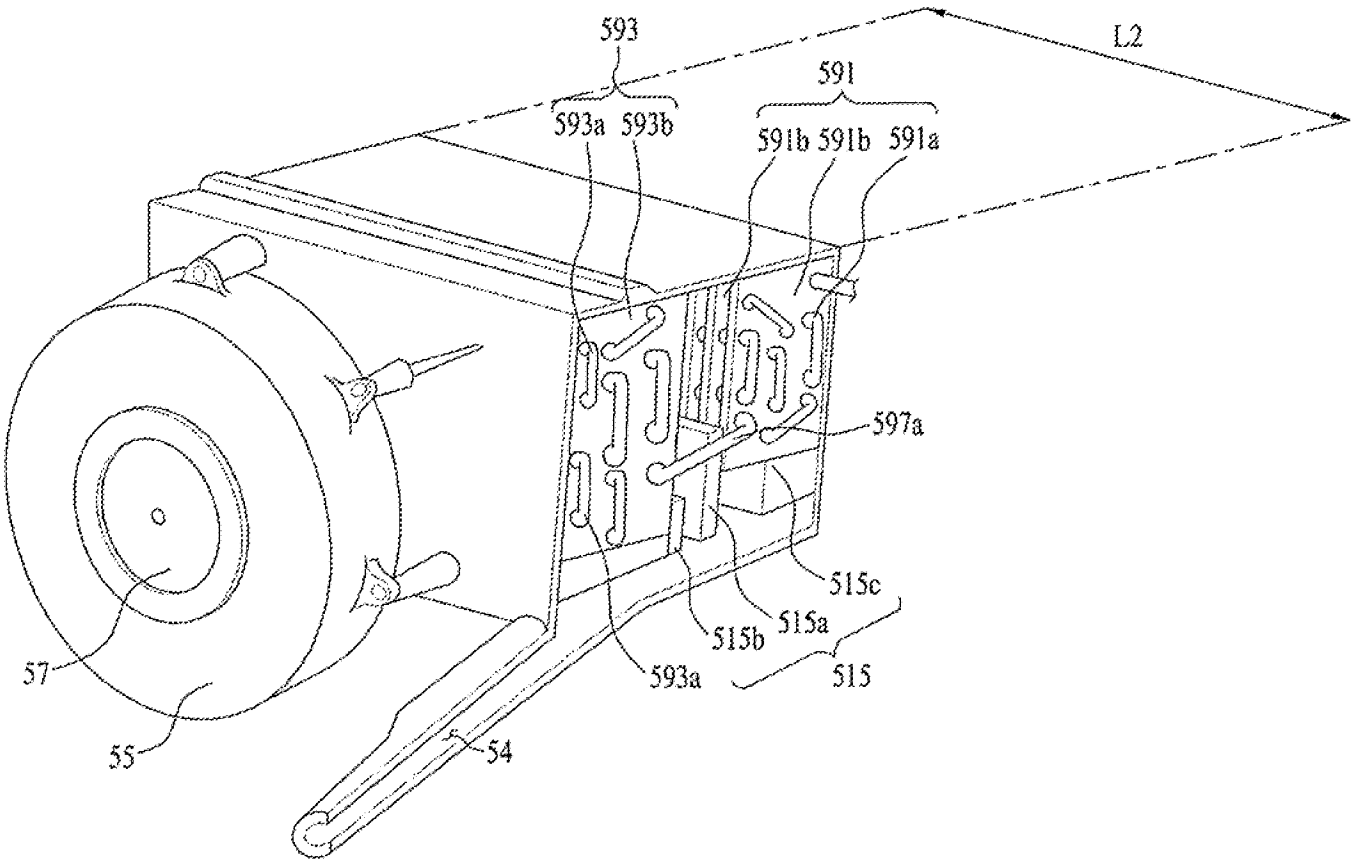
FIGS. 3, 4A and 4B are views of a heat exchanger of the laundry treating apparatus of FIG. 1.

FIG. 3 illustrates that the heat exchanger 59 provided in the clothes treating apparatus according to embodiments may be a heat pump. A first heat exchanger 591 (evaporator) and a second heat exchanger 593 (condenser) provided at the heat exchanger 59 may be fixed to an inside of the duct 51, and a compressor 595 may be provided to supply a refrigerant discharged from the evaporator 591 to the condenser 593 after compressing the refrigerant. The refrigerant supplied to the condenser 593 may be re-supplied to the evaporator 591 via an expansion device 597.

The evaporator 591 may include first heat exchange plates 591*b*, and first refrigerant pipes 591*a* fixed to the first heat exchange plates 591*b*. For example, the first heat exchange plates 591*b* may include a plurality of metallic plates fixed in parallel in a lengthwise direction of the circulation passages (a moving direction of air). In this case, the first heat exchange plates 591*b* may be spaced from each other by a predetermined distance, in a widthwise direction (L2) of the circulation passages. The first refrigerant pipes 591*a*, which provide a moving path of a refrigerant, may be fixed to the first heat exchange plates 591*b*.

The evaporator 591 may evaporate a refrigerant after the refrigerant absorbs heat from air introduced into the duct 51. Thus, the evaporator 591 may serve as a means to remove moisture contained in air by cooling the air.

The duct 51 may further include a condensate water discharge unit or device 54 that discharges moisture removed from air (condensate water) by the evaporator 591 outside of the circulation passages. The condensate water discharge device 54 may be connected to the drain device 25 by a discharge pipe 541.

The condenser 593 may condense a refrigerant. Heat generated while a refrigerant is condensed may be transmitted to air passing through the condenser 593. Thus, the condenser 593 may serve as a means to heat air which has passed through the evaporator 591. The condenser 593 may include second heat exchange plates 593*b*, and second refrigerant pipes 593*a* fixed to the second heat exchange plates 593*b*.

The evaporator 591 and the condenser 593 may be fixed to a first mounting unit or device 515 provided in the duct 51. The first mounting device 515 may include a first supporting portion 515*c* that supports a lower surface of the evaporator 591, a second supporting portion 515*b* that supports a lower surface of the condenser 593, and a partition wall 515*a* provided between the evaporator 591 and the condenser 593. Such a configuration may prevent moisture removed from air passing through the evaporator 591 (condensate water) from moving to the condenser 593, and allow the condensate water to easily flow to the condensate water discharge device 54.

Figure 4A:
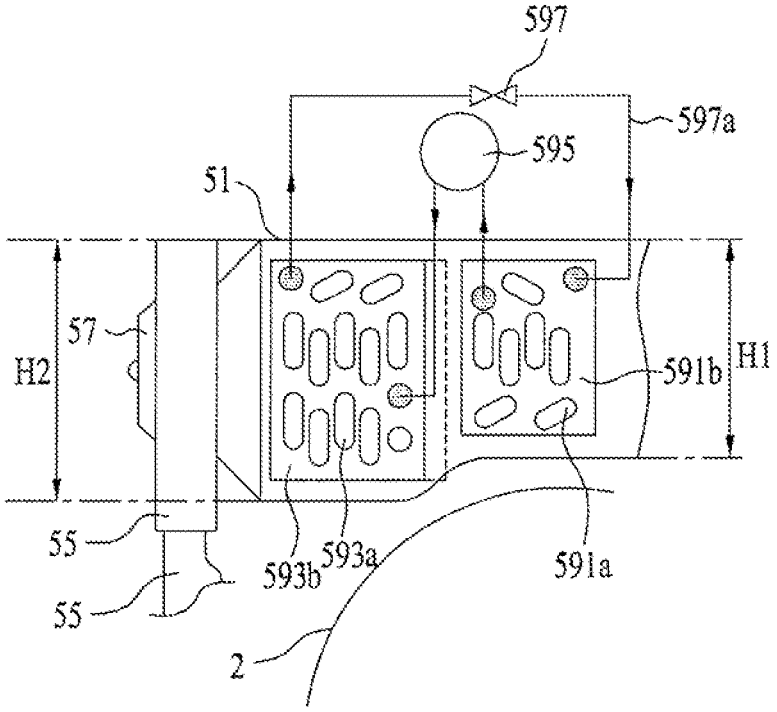

As shown in FIG. 4A, as the circulation passages 51, 53, and 55 may be positioned above the circumferential surface of the tub 2, and a space in which the evaporator 591 is positioned and a space in which the condenser 593 is positioned may have different volumes. If a duct height (H1) of a region in which the evaporator 591 is fixed is different from a duct height (H2) of a region in which the condenser 593 is fixed, a heat exchange amount of the evaporator 591 may be different from a heat exchange amount of the condenser 593. In this case, it may be difficult to solve such a difference between the heat exchange amount of the evaporator 591 and the heat exchange amount of the condenser 593, by merely increasing a volume of the evaporator 591 or the condenser 593, because the volume of the evaporator 591 or the condenser 593 is restricted by a shape of the duct 51.

More specifically, referring to FIG. 4A, it is difficult to increase a length of the second heat exchange plate 593*b* without changing a shape of the duct 51. The reason is because the second heat exchange plate 593*b* may interfere with the duct 51 even when a length of the second heat exchange plate 593*b* is increased toward the evaporator 591, for an increased volume of the condenser 593.

Figure 4B:
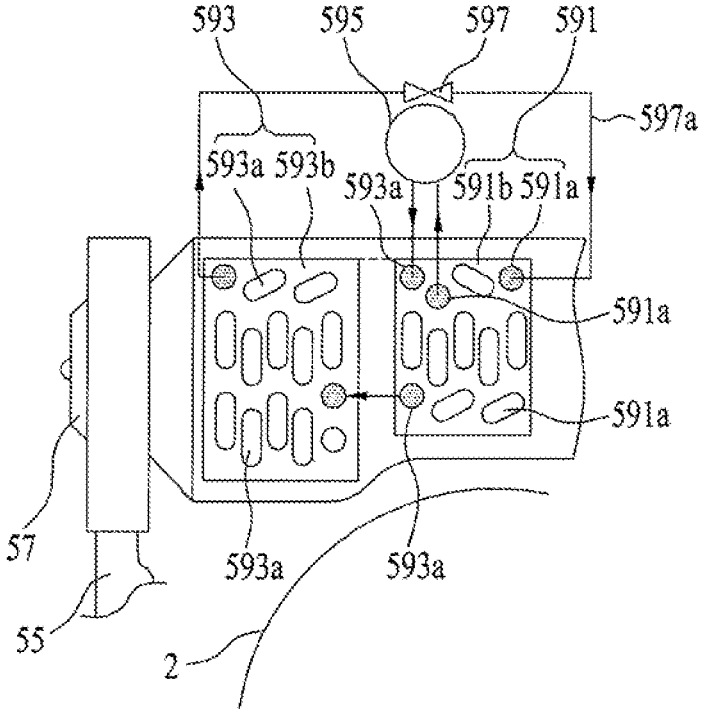

In order to solve such a problem, the condenser 593 may be formed such that a portion of its refrigerant pipes is fixed to the first heat exchange plates 591*b* of the evaporator 591. As shown in FIG. 4B, the evaporator 591 may include the first heat exchange plates 591*b* and the first refrigerant pipes 591*a* fixed to the first heat exchange plates 591*b*. The condenser 593 may include the second heat exchange plates 593*b* that exchange heat with air having passed through the first heat exchange plates 591*b*, and the second refrigerant pipes 593*a* fixed to the second heat exchange plates 593*b*. In this case, a portion of the second refrigerant pipes 593*a* may be fixed to the first heat exchange plates 591*b* of the evaporator 591.

More specifically, a refrigerant, which has passed through the first heat exchange plates 591*b* via the first refrigerant pipes 591*a*, may be introduced into the second refrigerant pipe 593*a* via the compressor 595. The second refrigerant pipe 593*a* may pass through the first heat exchange plates 591*b* and the second heat exchange plates 593*b*, sequentially. With such a structure, a length of the second refrigerant pipes 593*a* may be increased, and thus, a heat exchange amount of the evaporator 591 may become equal to a heat exchange amount of the condenser 593. Further, the refrigerant, discharged from the second heat exchange plates 593*b* through the second refrigerant pipes 593*a*, may be re-supplied to the first refrigerant pipes 591*a* via a connection pipe 597*a* and the expansion device 597.

The laundry treating apparatus 100 may further include a filter unit or device 7 that prevents lamination of foreign materials on the heat exchanger 59, by filtering air introduced into the circulation passages 51, 53, and 55 after being discharged from the tub 2.

Figure 5:
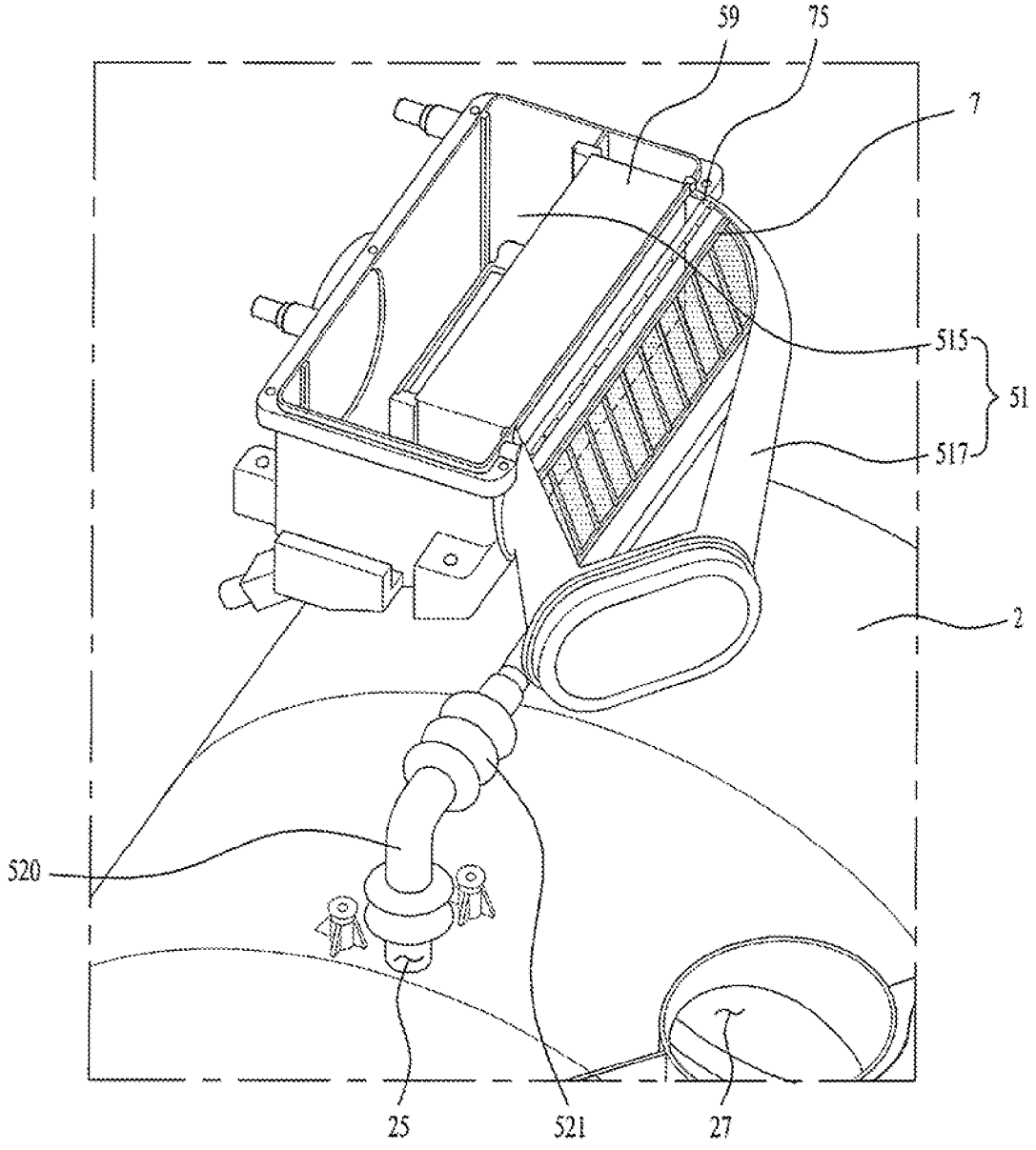
FIGS. 5 and 6A to 6C are views illustrating a duct including a filter device and the heat exchanger of the laundry treating apparatus of FIG. 1.

FIG. 5 illustrates the duct 51 including the heat exchanger 59 and the filter device 7 according to one embodiment. The duct 51 may include the first mounting device 515, on which the heat exchanger 59 may be mounted, and a second mounting unit or device 517, on which the filter device 7 may be mounted.

The heat exchanger 59 may include the first heat exchanger 591 (evaporator) that evaporates refrigerant, the second heat exchanger 593 (condenser) that condenses refrigerant, and the compressor 595 that compresses refrigerant discharged from the evaporator 591 and supplies the refrigerant to the condenser 593. The evaporator 591 and the condenser 593 provided at the heat exchanger 59 may be fixed to the inside of the duct 51, and the compressor 595 may compress refrigerant discharged from the evaporator 591 and supply the refrigerant to the condenser 593. The refrigerant supplied to the condenser 593 may be re-supplied to the evaporator 591 via the expansion device 597.

The evaporator 591 may evaporate refrigerant after the refrigerant absorbs heat from air introduced into the duct 51. Thus, the evaporator 591 may serve as a means to remove moisture contained in air by cooling the air.

The condenser 593 may condense refrigerant. Heat generated while the refrigerant is condensed maybe transmitted to air passing through the condenser 593. Thus, the condenser 593 may be a means to heat air which has passed through the evaporator 591.

The filter device 7 may be provided at or on the second mounting device 517 of the duct 51, and a washer 75 that washes the filter device 7 and the heat exchanger 59 may be provided between the filter device 7 and the heat exchanger 59. The washer 75, provided between the filter device 7 and the heat exchanger 59, may spray washing water or water to or onto the filter device 7 and the heat exchanger 59. With such a configuration, both the filter device 7 and the heat exchanger 59 may be cleaned.

Washing water, which has been used to remove foreign materials on surfaces of the filter device 7 and the heat exchanger 59, after being sprayed from the washer 75 towards the filter device 7 and the heat exchanger 59, may be discharged outside through a discharge duct 541 provided at the duct 51.

As discussed above, vibrations may occur from the duct 51 having therein the heat exchanger 59 and the blower 57 (refer to FIG. 2). In order to prevent vibrations generated from the duct 51 from being transmitted to the tub 2, the discharge duct 541 may be provided with a bellows 521. The washing water, which has been used to clean the filter device 7 and the heat exchanger 59, after being sprayed from the washer 75, may be discharged outside through the discharge duct 541, via the drain device 25 provided at the tub 2. Alternatively, the washing water may be discharged outside through the exhaust device 27 and the supply device 29 each provided on an outer circumferential surface of the tub 2. The washing water may be discharged outside through any opening (not shown) provided at the tub 2, if the opening communicates with the drain device 25 on the outer circumferential surface of the tub 2.

Figure 6A:
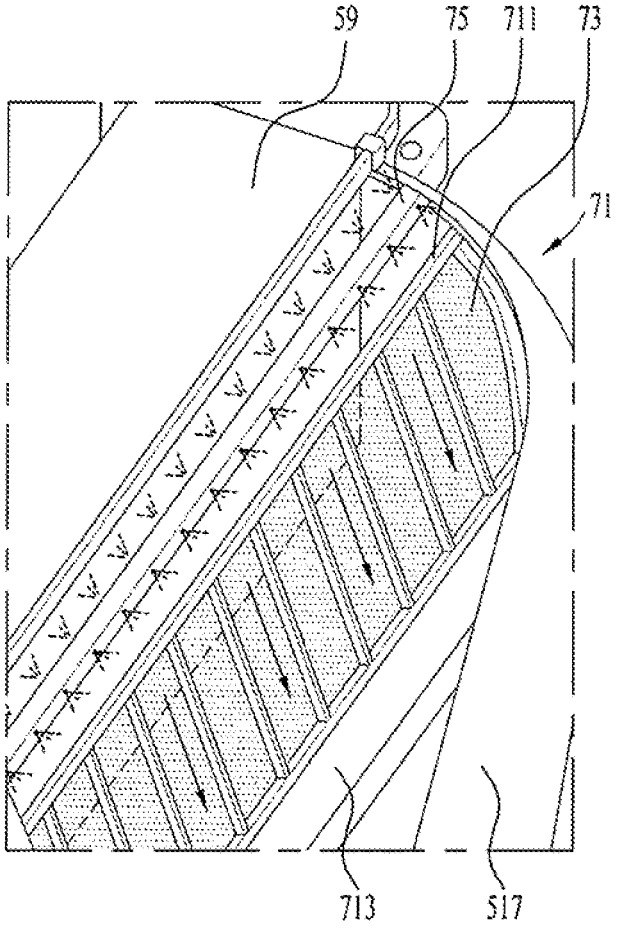
Figure 6B:
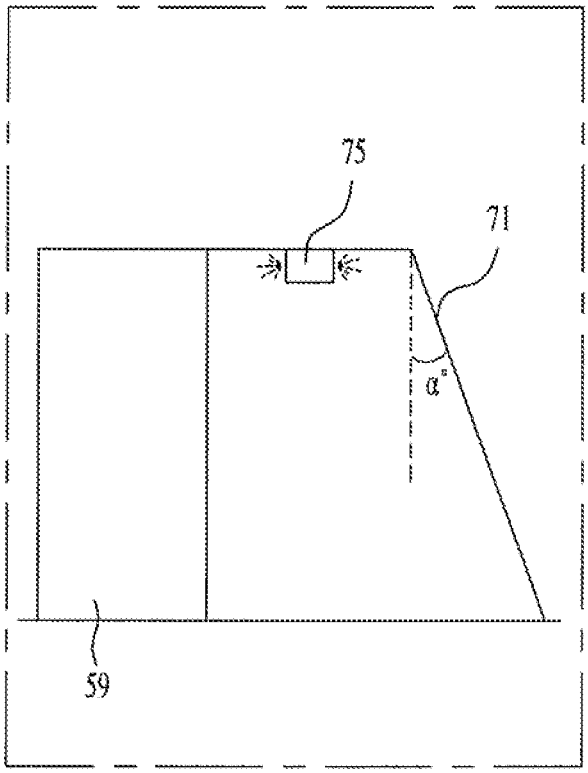
Figure 6C:
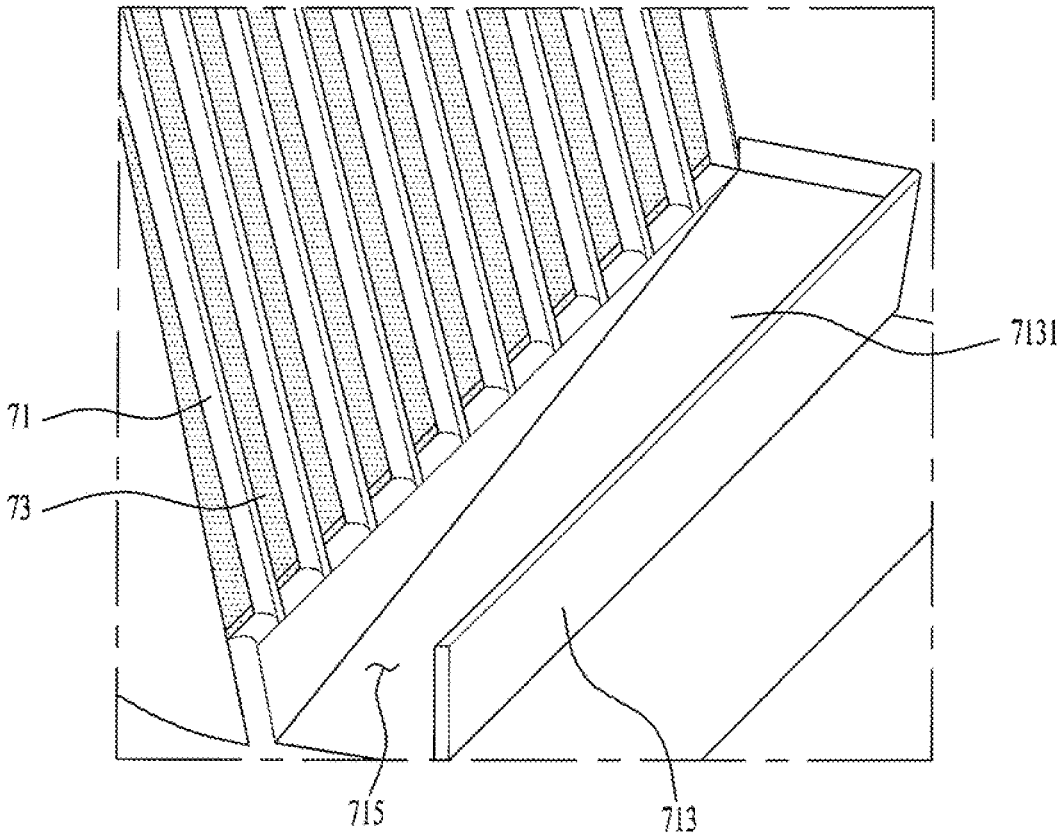

FIGS. 6A to 6C illustrate the filter device 7 of the laundry treating apparatus according to an embodiment. Referring to FIG. 6A, the filter device 7 may include a filter frame 71 provided at the second mounting device 517, a filter 73 provided at the filter frame 71 to filter foreign materials, and the washer 75 to wash (clean) the heat exchanger 59 and the filter device 7 by spraying washing water to the heat exchanger 59 and the filter device 7.

The filter frame 71 may include a body 711, a guider 713 provided on a lower surface of the body 711 to guide foreign materials having passed through the filter 73, and an open surface 715 provided at an end of the guider 713 to communicate the guider 713 with the discharge duct 541.

FIG. 6B illustrates a side surface of the filter device 7 provided in the duct 51 according to an embodiment. The body 711 of the filter device 7 may be arranged to have an angle of $\alpha°$ from a straight line (X) perpendicular to a lower surface of the duct 51. The body 711 may be inclined in order to allow washing water sprayed from the washer 75 to easily flow down along the filter frame 71 and the filter 73 (mesh) and reach the guider 713.

Referring to FIG. 6C, the guider 713 may be further provided with an inclined surface 7131 inclined toward the open surface 715. Due to the inclined surface 7131, washing water and foreign materials, which have passed through the filter 73, may be more easily discharged toward the discharge duct 541.

FIGS. 7A to 7D illustrates the washer 75 and a water supply unit or device 8 according to an embodiment. The washer 75 may include a nozzle body 751, and one or more nozzle holes 753 provided at the nozzle body 751 to spray washing water.

Figure 7A:
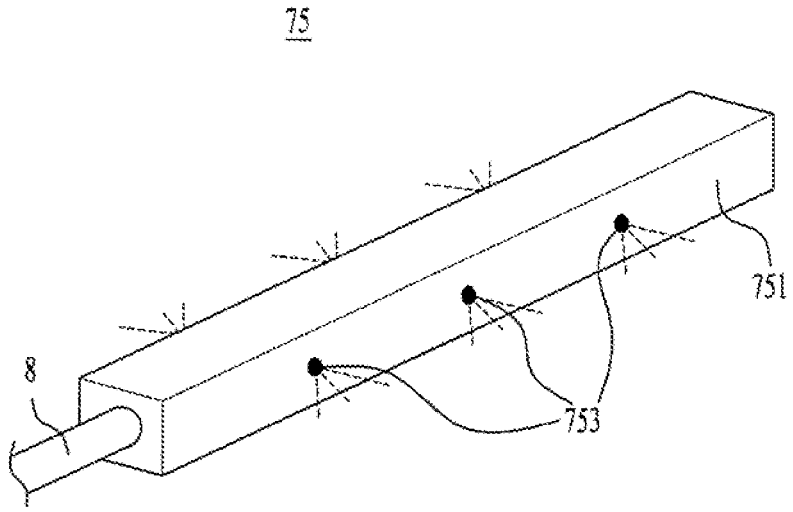
FIGS. 7A to 7D are views illustrating a washer of the laundry treating apparatus of FIG. 1.

Referring to FIG. 7A, the washer 75 may be provided with a single nozzle body 751, and the nozzle body 751 may be provided with one or more nozzle holes 753 on a surface that faces the heat exchanger 59 and the filter device 7. The water supply device 8, provided to supply washing water, may be further provided at the nozzle body 751.

Figure 7B:
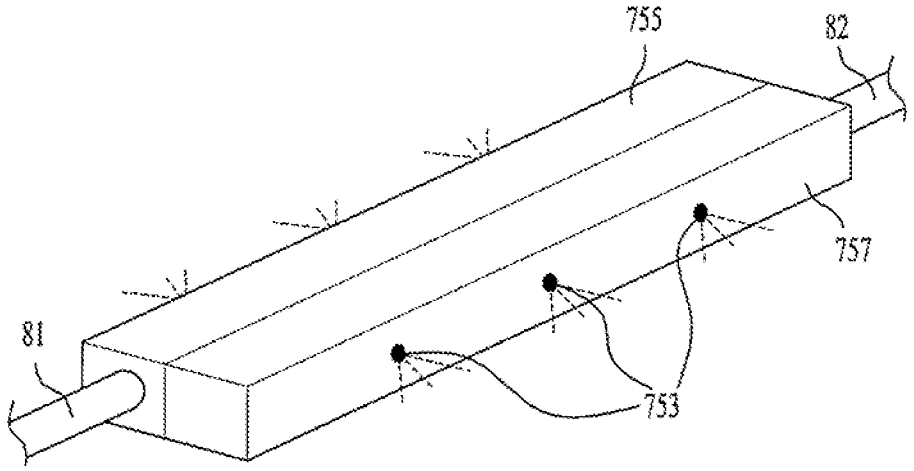

Referring to FIG. 7B, the washer 75 may include a heat exchanger washing portion 755 to spray washing water toward the heat exchanger 59, and a filter washing portion 757 to spray washing water toward the filter 73. The heat exchanger washing portion 755 may include one or more nozzle holes 753 provided on a surface thereof facing toward the heat exchanger 59. The one or more nozzle holes 753 may spray washing water toward the heat exchanger 59. The filter washing portion 757 may include one or more nozzle holes 753 provided on a surface thereof facing toward the filter device 7. The one or more nozzle holes 753 may spray washing water toward the filter device 7.

A first water supply device 81 to supply washing water to the heat exchanger washing portion 755, and a second water supply device 82 to supply washing water to the filter washing portion 757, may be further provided. Unlike in FIG. 7A, as shown in FIG. 7B, as the first water supply device 81 and the second water supply device 82 are independently provided unlike in FIG. 7A, water supply may be independently executed on the heat exchanger washing portion 755 and the filter washing portion 757.

Figure 7C:
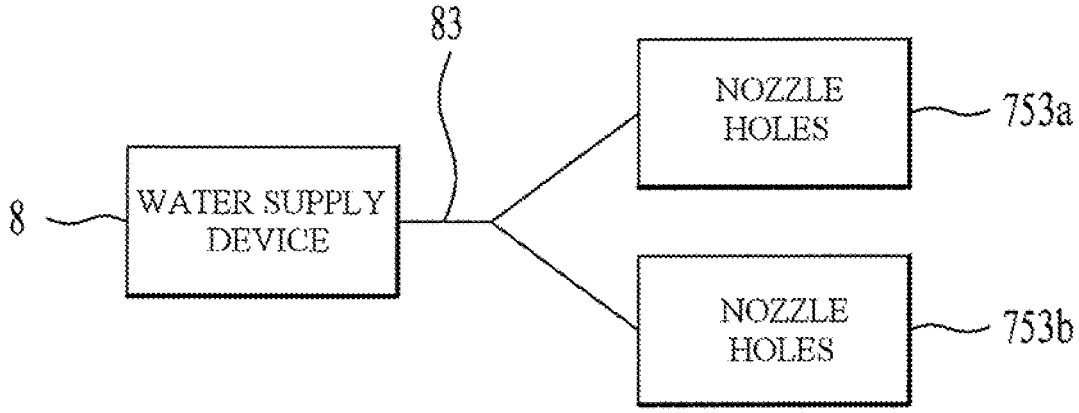
Figure 7D:
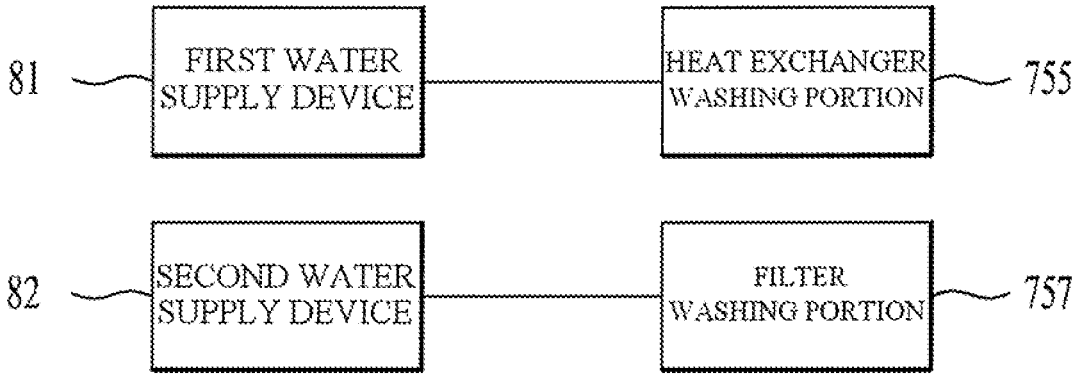

FIGS. 7C and 7D illustrate the water supply device 8, the heat exchanger washing portion 755, and the filter washing portion 757 according to an embodiment. Referring to FIG. 7C, washing water supplied from the water supply device 8 may be transferred to one or more nozzle hole(s) 753*a* that face the heat exchanger 59, and one or more nozzle hole(s) 753*b* that face the filter device 7, by a divergence pipe 83. Referring to FIG. 7D, according to another embodiment, the water supply device 8 may further include the first water supply device 81 to supply washing water to the heat exchanger washing portion 755, and the second water supply device 82 to supply washing water to the filter washing portion 757. The first water supply device 81 and the second water supply device 82 may be provided so as to be controlled independently.

Figure 8:
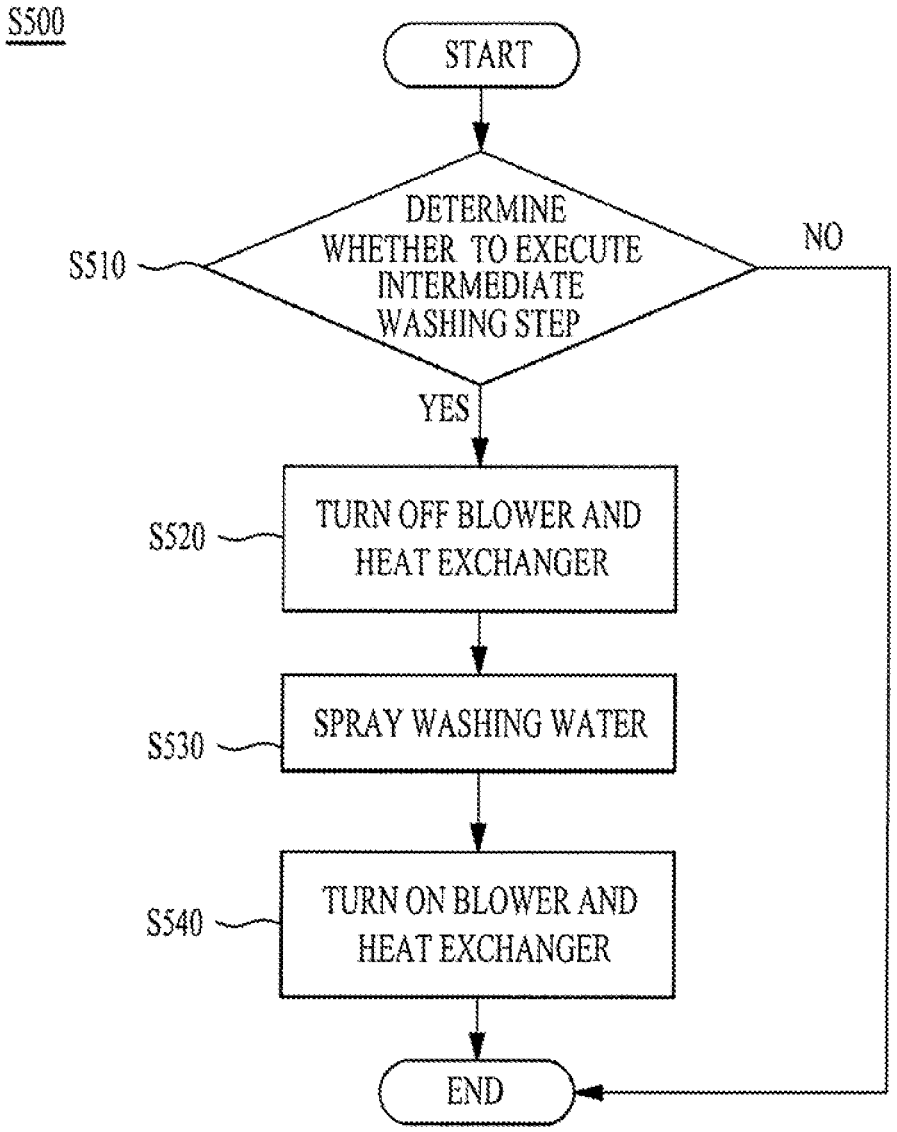
FIG. 8 is a flow chart of a method for controlling the washer of the laundry treating apparatus of FIG. 1.

FIG. 8 is a view illustrating control of the washer 75 provided at a laundry treating apparatus according to an embodiment. Generally, a laundry treating apparatus executes a washing step or operation of supplying washing water and a detergent into the tub 2, and washing laundry by rotating the drum 3, a rinsing step or operation of removing the detergent included in the laundry after the washing step or operation, a dehydration step or operation of removing moisture included in the laundry after the rinsing step, and a drying step or operation of drying the laundry.

An intermediate washing step or operation, S500, according to an embodiment may be executed before or after each of the washing step or operation, the rinsing step or operation, the dehydration step or operation, and the drying step or operation. Further, the intermediate washing step or operation, S500, may be performed a plurality of times, rather than a single time (once).

The intermediate washing step or operation, S500, may include an intermediate washing determination step or operation, S510, of determining whether to execute the intermediate washing step, S500, or not according to a user's input or a control method input to a controller. The intermediate washing step or operation, S500, may further include a power-off step or operation, S520, of turning off the blower 57 and the heat exchanger 59 when it is determined in the intermediate washing determination step or operation, S510, that the intermediate washing step or operation, S500, is to be executed.

The intermediate washing step or operation, S500, may further include a washing water spraying step or operation, S530, of spraying washing water to the heat exchanger 59 and the filter device 7 by the washer 75, after the blower 57 and the heat exchanger 59 are turned off in the power-off step or operation, S520. The intermediate washing step or operation, S500, may further include a power-on step or operation, S540, of turning on again the blower 57 and the heat exchanger 59, which have been turned off in the power-off step or operation, S520, after the washing water spraying step or operation, S530.

Therefore, embodiments disclosed herein provide a laundry treating apparatus capable of cleaning a filter device that filters air supplied to a heat exchanger, and the heat exchanger.

Embodiments disclosed herein provide a laundry treating apparatus that may include a laundry accommodation unit or device configured to provide a space where laundry may be accommodated; a circulation passage provided outside of the laundry accommodation unit, and providing a space where air circulates via an inside of the laundry accommodation unit; a heat exchange unit or heat exchanger provided in the circulation passage; a filter unit or device disposed or provided in the circulation passage, and configured to filter foreign materials introduced into the heat exchange unit; and a washing unit or washer disposed or provided between the heat exchange unit and the filter unit, and configured to spray washing water to each of the heat exchange unit and the filter unit. The filter unit may include a filter frame provided at the circulation passage, and a filter provided at the filter frame, and configured to filter foreign materials.

The filter frame may include a body arranged to have an inclination angle from a straight line perpendicular to a bottom surface of the circulation passage, a guider provided on a lower surface of the body and configured to guide washing water sprayed by the washing unit, and an open surface provided at the end of the guider and configured to communicate the guider with a discharge duct. The guider may be further provided with an inclined surface provided on a lower surface of the guider, and inclined toward the open surface. The discharge duct may be configured to communicate with a drain unit or drain provided at a tub of the laundry accommodation unit.

The washing unit may include a nozzle body, and one or more nozzle holes provided at each of both side surfaces of the nozzle body that face the heat exchange unit and the filter unit, and configured to spray washing water. The washing unit may further include a water supply unit or device configured to supply washing water into the nozzle body. The water supply unit may further include a divergence pipe configured to diverge washing water to a nozzle hole that faces the heat exchange unit, and a nozzle hole that faces the filter unit.

The washing unit may include a heat exchange unit washing portion configured to spray washing water toward the heat exchange unit, a filter unit washing portion configured to spray washing water toward the filter unit, and a water supply unit or device configured to supply washing water to the washing unit. The water supply unit may include a first water supply unit or device configured to supply washing water to the heat exchange unit washing portion, and a second water supply unit or device configured to supply washing water to the filter unit washing portion. The first water supply unit and the second water supply unit may be operated independently.

Embodiments disclosed herein provide a method for controlling a laundry treating apparatus including a heat exchange unit or heat exchanger disposed or provided in a circulation passage that provides a space such that air circulates via inside of a laundry accommodation unit or device; a filter unit or device configured to filter foreign materials introduced into the heat exchange unit; and a washing unit or washer disposed or provided between the heat exchange unit and the filter unit, and configured to spray washing water to each of the heat exchange unit and the filter unit. The method may include an intermediate washing step or operation of washing the heat exchange unit and the filter unit.

The intermediate washing step may be executed before or after at least one of a washing step or operation of washing laundry, a rinsing step or operation of rinsing laundry, a dehydration step or operation of dehydrating laundry, and a drying step or operation of drying laundry. The intermediate washing step may include an intermediate washing determination step or operation of determining whether to execute the intermediate washing step or not; a power-off step or operation of turning off a blower and the heat exchange unit when it is determined in the intermediate washing determination step that the intermediate washing step is to be executed; a washing water spraying step or operation of spraying washing water to the heat exchange unit and the filter unit by the washing unit, after the power-off step; a power-on step or operation of turning on again the blower and the heat exchange unit, after the washing water spraying step.

Embodiments disclosed herein provide a laundry treating apparatus that can clean a filter device that filters air supplied to a heat exchanger, and the heat exchanger.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:
- a laundry accommodation device that provides a space for laundry to be accommodated;
- a circulation passage provided outside of the laundry accommodation device, and providing a space in which air circulates to an inside of the laundry accommodation device;
- a heat exchanger provided in the circulation passage;
- a filter device provided in the circulation passage, that filters foreign materials introduced to the heat exchanger; and
- a washer provided between the heat exchanger and the filter device, that sprays washing water onto each of the heat exchanger and the filter device, wherein the filter device includes:
  - a filter frame provided at the circulation passage; and
  - a filter provided at the filter frame, that filters foreign materials, wherein the filter frame includes:
    - a body arranged at an inclination angle from a straight line perpendicular to a bottom surface of the circulation passage;
    - a guider provided on a lower surface of the body, that guides washing water sprayed by the washer; and
    - an open surface provided at an end of the guider by which the guider communicates with a discharge duct, and wherein the guider includes an inclined surface provided on a lower surface of the guider and inclined toward the open surface.

2. The laundry treating apparatus of claim 1, wherein the discharge duct communicates with at least one of a drain device, an exhaust device, or a supply device, which are provided at a tub of the laundry accommodation device.

3. The laundry treating apparatus of claim 1, wherein the washer includes:
- a nozzle body; and
- one or more nozzle holes that spray washing water provided at each of both side surfaces of the nozzle body to face the heat exchanger and the filter device.

4. The laundry treating apparatus of claim 3, wherein the washer further includes a water supply device that supplies washing water into the nozzle body, and wherein the water supply device further includes a divergence pipe that diverts washing water to the one or more nozzle holes that face heat exchanger, and one or more nozzle holes that face the filter device.

5. The laundry treating apparatus of claim 1, wherein the washer includes:
- a heat exchanger washing portion that sprays washing water toward the heat exchanger;
- a filter washing portion configured to spray washing water toward the filter device; and
- a water supply device that supplies washing water to the washer.

6. The laundry treating apparatus of claim 5, wherein the water supply device includes:
- a first water supply device that supplies washing water to the heat exchanger washing portion; and
- a second water supply device that supplies washing water to the filter washing portion.

7. The laundry treating apparatus of claim 6, wherein the first water supply device and the second water supply device are operated independently.

8. The laundry treating apparatus of claim 1, wherein the washer includes:
- a nozzle body;
- one or more nozzle holes that spray washing water provided at each of both side surfaces of the nozzle body to face the heat exchanger and the filter device; and
- a water supply device that supplies washing water into the nozzle body.

9. A laundry treating apparatus, comprising:
- a laundry accommodation device that provides a space for laundry to be accommodated;
- a circulation passage provided outside of the laundry accommodation device, and providing a space in which air circulates to an inside of the laundry accommodation device;
- a heat exchanger provided in the circulation passage;
- a filter device provided in the circulation passage, that filters foreign materials introduced to the heat exchanger; and
- a washer provided in the circulation passage between the heat exchanger and the filter device, that sprays washing water onto each of the heat exchanger and the filter device, wherein the filter device includes:
  - a filter frame removably provided in the circulation passage; and
  - a filter provided on the filter frame, that filters foreign materials, wherein the filter frame includes:
    - a body arranged at an inclination angle from a straight line perpendicular to a bottom surface of the circulation passage;
    - a guider provided on a lower surface of the body, that guides washing water sprayed by the washer; and
    - an open surface provided at an end of the guider by which the guider communicates with a discharge duct that communicates with at least one of a drain device, an exhaust device, and a supply device, which are provided at a tub of the laundry accommodation device, and wherein the guider includes an inclined surface provided on a lower surface of the guider and inclined toward the open surface.

* * * * *